US006170700B1

(12) United States Patent
Lewis et al.

(10) Patent No.: US 6,170,700 B1
(45) Date of Patent: Jan. 9, 2001

(54) LEAFLET DISPENSING APPARATUS

(75) Inventors: Graham Lewis, Montreal; Louis Pallay, Beaconsfield, both of (CA)

(73) Assignee: Kalish Canada Inc., Kirkland (CA)

( * ) Notice: Under 35 U.S.C. 154(b), the term of this patent shall be extended for 0 days.

(21) Appl. No.: 09/187,367

(22) Filed: Nov. 6, 1998

(51) Int. Cl.[7] ..... B65G 59/00

(52) U.S. Cl. ..... 221/120; 221/119; 221/121; 221/104; 221/112; 221/210; 221/211; 156/568; 156/570; 156/571

(58) Field of Search ..... 221/119, 120, 221/121, 122, 103, 104, 112, 113, 115, 210, 211; 156/566, 567, 568, 569, 570, 571; 271/112, 113, 94

(56) References Cited

U.S. PATENT DOCUMENTS

| | | | |
|---|---|---|---|
| 3,150,476 | 9/1964 | Logez et al. . | |
| 3,313,090 * | 4/1967 | Kerrigan | 53/390 |
| 3,915,448 * | 10/1975 | Total | 271/94 |
| 4,021,293 | 5/1977 | Total . | |
| 4,059,264 | 11/1977 | Vogel . | |
| 4,333,586 * | 6/1982 | Stuckler | 221/106 |
| 4,564,412 * | 1/1986 | Oberdorf | 156/484 |
| 4,605,459 * | 8/1986 | Voltmer et al. | 156/568 X |
| 4,620,891 | 11/1986 | Applegate et al. . | |
| 4,890,753 | 1/1990 | Duryee et al. . | |
| 4,986,524 * | 1/1991 | Meintzer, Jr. et al. | 221/211 X |
| 5,209,046 | 5/1993 | Tapscott et al. . | |
| 5,343,673 | 9/1994 | Beanland . | |
| 5,405,487 | 4/1995 | Galchefski et al. . | |
| 5,481,848 | 1/1996 | Tagliaferri et al. . | |
| 5,545,286 * | 8/1996 | Schaupp | 221/105 X |
| 5,569,353 | 10/1996 | Zodrow . | |
| 5,588,280 | 12/1996 | Kotsiopoulos . | |

FOREIGN PATENT DOCUMENTS

| | | |
|---|---|---|
| 645649 | 7/1992 | (AU) . |
| 0 161 357 | 11/1985 | (EP) . |

* cited by examiner

*Primary Examiner*—Christopher P. Ellis
*Assistant Examiner*—Patrick Mackey
(74) *Attorney, Agent, or Firm*—Ratner & Prestia

(57) ABSTRACT

A leaflet dispensing apparatus having a main structural body on which is mounted a carousel including a plurality of magazine for storing leaflets and an intermediate chute for transferring the leaflets from the carousel to a dispensing wheel. The dispensing wheel is adapted to remove a leaflet from the intermediate chute and to transport the leaflet to a dispensing area where a dispensing blade pushes the leaflet onto or into a container being transported by a conveyor located adjacent to the leaflet dispensing apparatus. The magazines for storing leaflets are the vehicle for reloading the carousel. The magazines may be discarded after use or may be re-used.

11 Claims, 10 Drawing Sheets

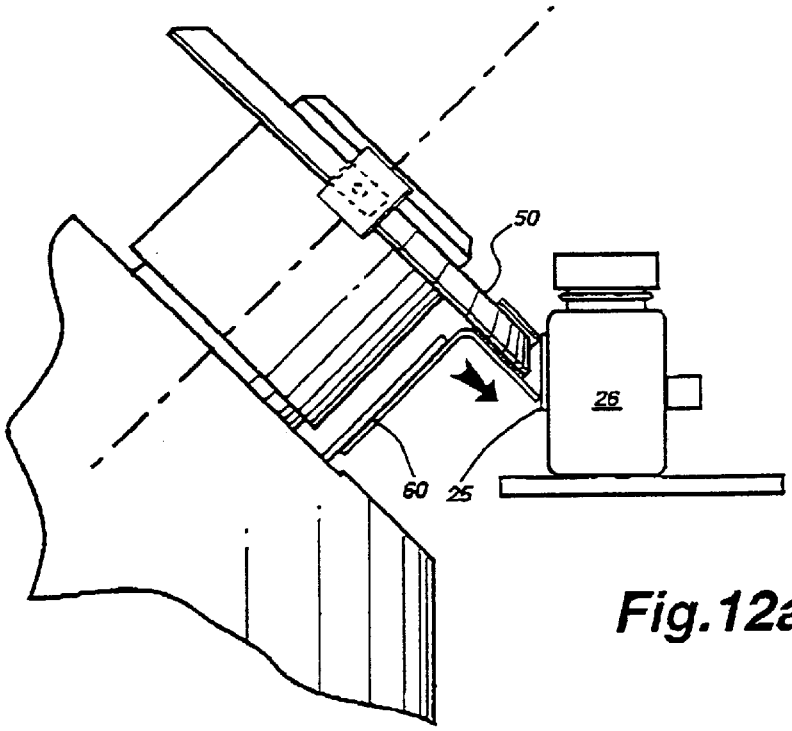
Fig.12a
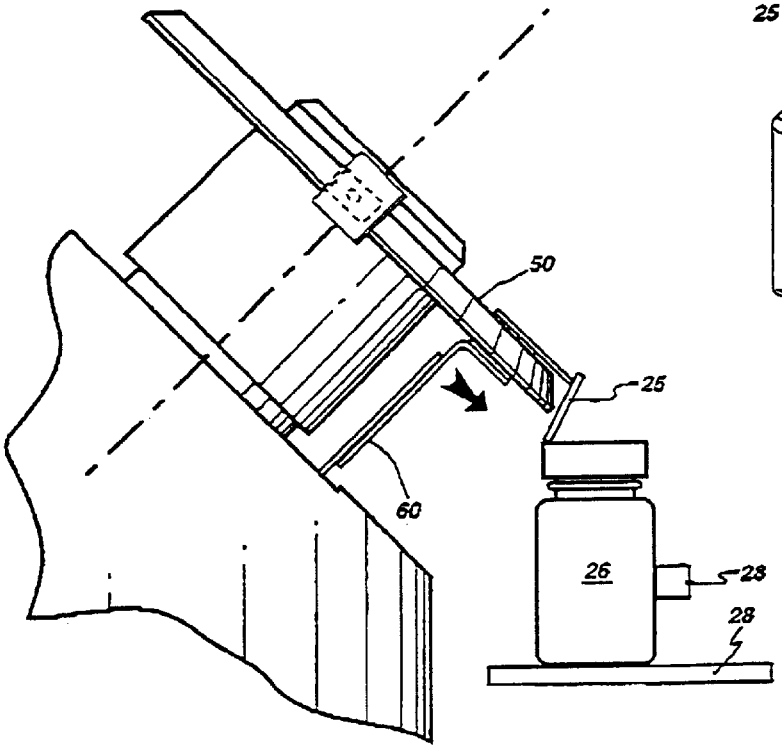
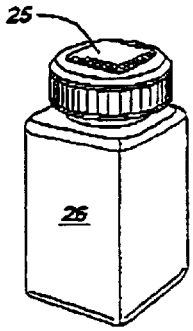
Fig.14a
Fig.14

LEAFLET DISPENSING APPARATUS

FIELD OF THE INVENTION

The invention relates in general to an apparatus for positioning leaflets on containers or inserting leaflets inside containers in a production environment. The invention finds applications mainly in the pharmaceutical industry where comprehensive information about the product may be included in each container sold in the market. The apparatus is positioned next to a conveyor system on which containers are transported and then adjusted to either affix leaflets to the outer part of the containers or insert leaflets inside the containers. The apparatus allows easy refilling of leaflets and can be rapidly adapted to dispense leaflets of different sizes.

BACKGROUND OF THE INVENTION

Many consumer products, especially pharmaceutical products are required to provide information about the product and/or instructions on the use of the product with each package sold on the market. Square folded leaflets is the most common format for providing that information to the consumer and these may come in a variety of sizes. Leaflets are either inserted into the package or affixed to an outer portion of the package. Many machines have been developed to insert leaflets into containers by means of endless belts with clips which effectively carry and hold the leaflet until it is dumped into the container. Machines designed to affix leaflets to the outer part of a container are not as common and one must look at labeling machines to find devices that produce a similar result. However, labels are usually made of more resilient material than leaflets, are not folded, and one side is often coated with a strong glue. These machines are often complex and require that the container be held firmly when the label is applied to the outer part of the container. Machines designed to both insert leaflets into containers or affix leaflets to the outer part of containers are practically non-existing.

In all machines of the prior art, the mechanisms for feeding leaflets or labels to the dispensing area are unreliable and cumbersome and problems arise during operation. Leaflets may get misaligned or get caught and the production must be stopped to rearrange the stored leaflets. Leaflets are often stored and fed through a cartridge that features spring loaded elements to push the row of leaflets to the dispensing area. Once the cartridge is emptied, it must be replaced and reloaded and this operation may require that the machine be stopped.

Considering the wide application, especially in the pharmaceutical industry, of this type of apparatus, there is a demand for an leaflet dispensing apparatus better adapted to position leaflets either on a container or inside a container, that is compact, easy to operate and reliable.

OBJECTS AND STATEMENT OF THE INVENTION

It is thus an object of the invention to provide a leaflet dispensing apparatus specifically adapted to be reloaded with new leaflets in a manner that is quick, simple and reliable.

It is another object of the invention to provide a leaflet dispensing apparatus that can affix leaflets to a plurality of position on a container and that can insert a leaflet inside a container.

It is another object of the invention to provide a simple mechanism for removing leaflets from a stored position and to transport leaflets to the dispensing area.

It is another object of the invention to provide magazines for packing leaflets and for use as pre-loaded cartridge for the production environment.

As embodied and broadly described herein, the invention provides a leaflet dispensing apparatus comprising:

a main structural body;

a carousel rotatably mounted to said main structural body, said carousel including a plurality of magazines adapted to hold leaflets, each of said magazine having at least one open extremity through which said leaflets may enter or exit, said magazines being disposed in an upright position wherein said at least one open extremity opens downwardly;

a retaining plate positioned below said magazines and adapted to close said at least one open extremity, said retaining plate including an orifice in communicative relation with an intermediate chute;

a dispensing wheel rotatably mounted to said main structural body having an angled peripheral side, said peripheral side including at least one pocket adapted to remove and transport said leaflets, said dispensing wheel in communicative relation with said intermediate chute; and a dispensing blade adapted to move a leaflet carried by said dispensing wheel towards a container.

As embodied and broadly described herein, the invention also provides a leaflet dispensing apparatus adapted to deposit pieces of folded printed matter into or onto small containers in a production line; said apparatus including a support, a main structural body and a revolvable carousel, said carousel being, in operation, adapted to transport a plurality of vertically disposed cartridges; said cartridges being adapted to be filled with said pieces of folded printed matter and to dispense the same by gravity into an intermediate chute; said apparatus further comprising a rotatable dispensing wheel; said dispensing wheel including a plurality of vacuum-actuated pockets about its periphery; each of said pockets being adapted in operation to receive one of said pieces of folded printed matter from said chute; said dispensing wheel being positioned on said apparatus such that each of said pockets is adapted to align one at a time with an exit port of said intermediate chute during rotation of said dispensing wheel; the periphery of said wheel being positioned adjacent a container conveyor and a removal knife such that, in operation, as each of said pockets approaches said conveyor said knife removes said pieces of folded printed matter and deposits it into or onto a container.

In a preferred embodiment of the invention, the leaflet dispensing apparatus comprises a main structural body on which a carousel, featuring a plurality of magazines each containing a predetermined quantity of leaflets, is mounted. The carousel is in communicative relation with an intermediate chute which enables the transfer of leaflets from a magazine of the carousel to a dispensing wheel located immediately below the intermediate chute. The dispensing wheel is a rotatable disc adapted, in operation, to remove a leaflet from the intermediate chute, to transfer and deliver the leaflet to an oncoming container transported on a conveyor belt. The dispensing wheel features a plurality of pockets each having a small vacuum chamber that creates the necessary suction to remove a leaflet from the intermediate chute and to hold the leaflet during transport to the container traveling on the conveyor belt. To assist in the positioning of the leaflet onto or into the container, a dispensing blade is preferably provided to push the leaflet at the opportune time i.e. when the leaflet is located next to the container. Glue may be applied to the leaflet as the leaflet is being transported by the dispensing wheel or it may be applied to the container itself upstream from the apparatus.

The carousel ensures a steady flow of properly oriented leaflets to the intermediate chute by storing the leaflets in magazines designed specifically to the effect. The carousel is constructed with a central star-wheel in which a plurality of magazines containing leaflets are placed in the upright position at regular intervals. In operation, one magazine is aligned with the intermediate chute in order to transfer its content of leaflets to the intermediate chute. Once a magazine is empty, the carousel rotates in a step-like manner to position the next full magazine in alignment with the intermediate chute. The intermediate chute acts as a buffer zone or reserve from the moment a magazine is empty to the moment a full magazine is brought in alignment with it. Once all the magazines of a carousel are empty, the entire carousel can be replaced quickly and easily with a new carousel carrying full magazines.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which:

FIG. 12*a* is a partial elevational view of the leaflet dispensing apparatus according to the invention shown of FIG. 12;

FIG. 14 is an enlarged side elevational view of the leaflet dispensing apparatus according to the invention affixing a leaflet on the top of a container;

FIG. 14*a* is a perspective view of a container with a leaflet affix on its up.

Figure 1:
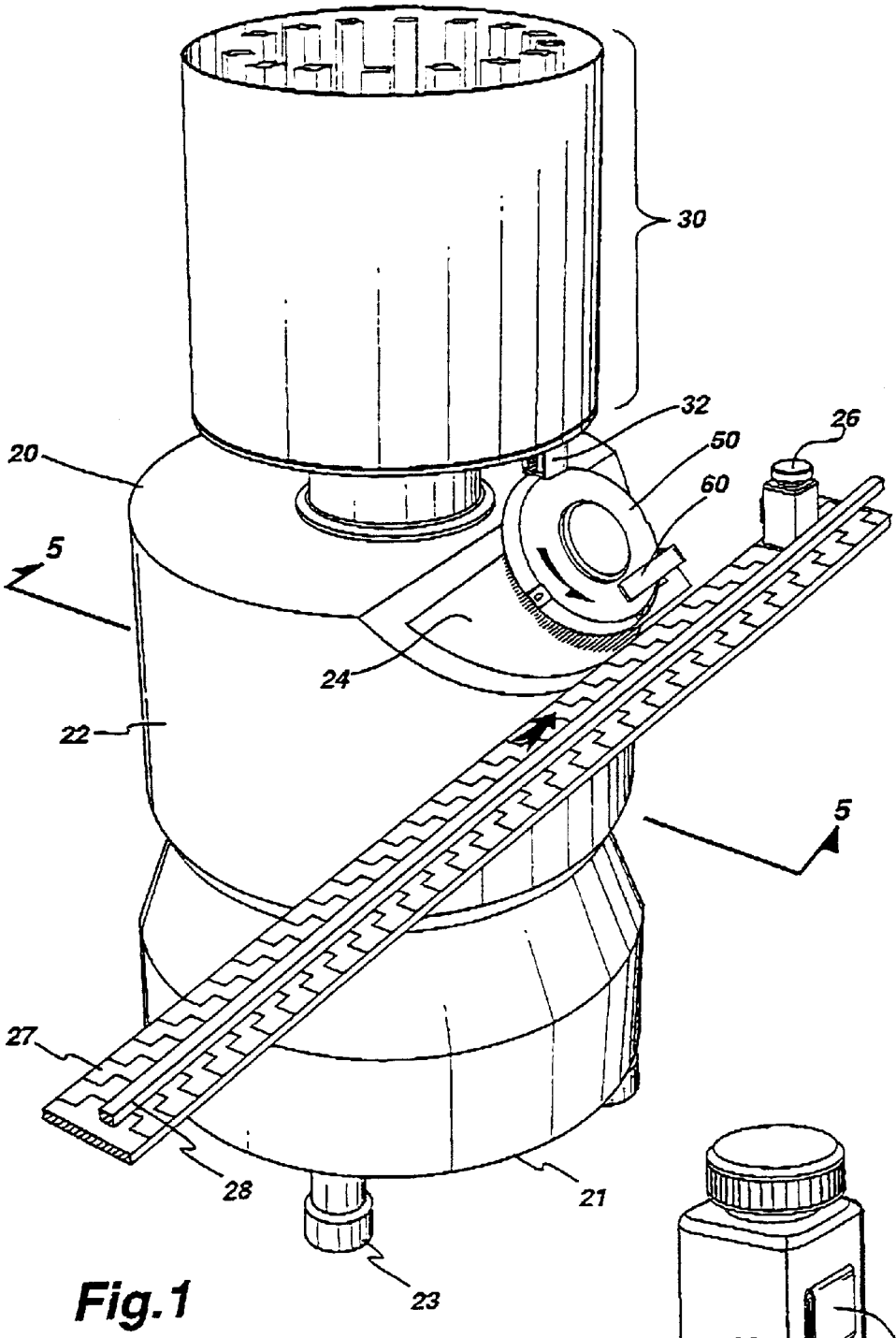
FIG. 1 is a perspective view illustrating the complete leaflet dispensing apparatus located next to a conveyor system according to the invention.
Figure 2:
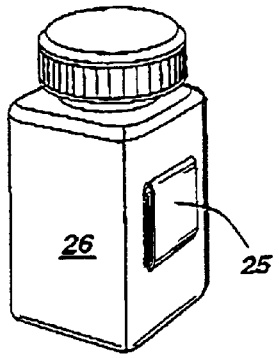
FIG. 2 is a perspective view of a container with a leaflet affixed to its side.

In the drawings, preferred embodiments of the invention are illustrated by way of examples. It is to be expressly understood that the description and drawings are only for the purpose of illustration and are an aid for understanding. They are not intended to define the limits of the invention.

DETAILED DESCRIPTION OF PREFERRED EMBODIMENTS

With reference to FIG. 1 of the annexed drawings, the present invention provides a novel leaflet dispensing apparatus designated by the reference numeral 20. The apparatus 20 is constructed of a supporting structure 21 featuring adjustable legs 23 provided to adjust the height of the apparatus, a main structural body 22 and a carousel 30 rotatably mounted to the main structural body 22 in which is stored leaflets 25 to be dispensed. The main structural body 22 is constructed with an angular section 24 to which is mounted a rotatable dispensing wheel 50 adapted to retrieve leaflets 25 from carousel 30 and, to transport and deliver the leaflets 25, one by one, to a container 26 traveling on a conveyor system 27 and guided and supported by a guide rail 28.

Figure 3:
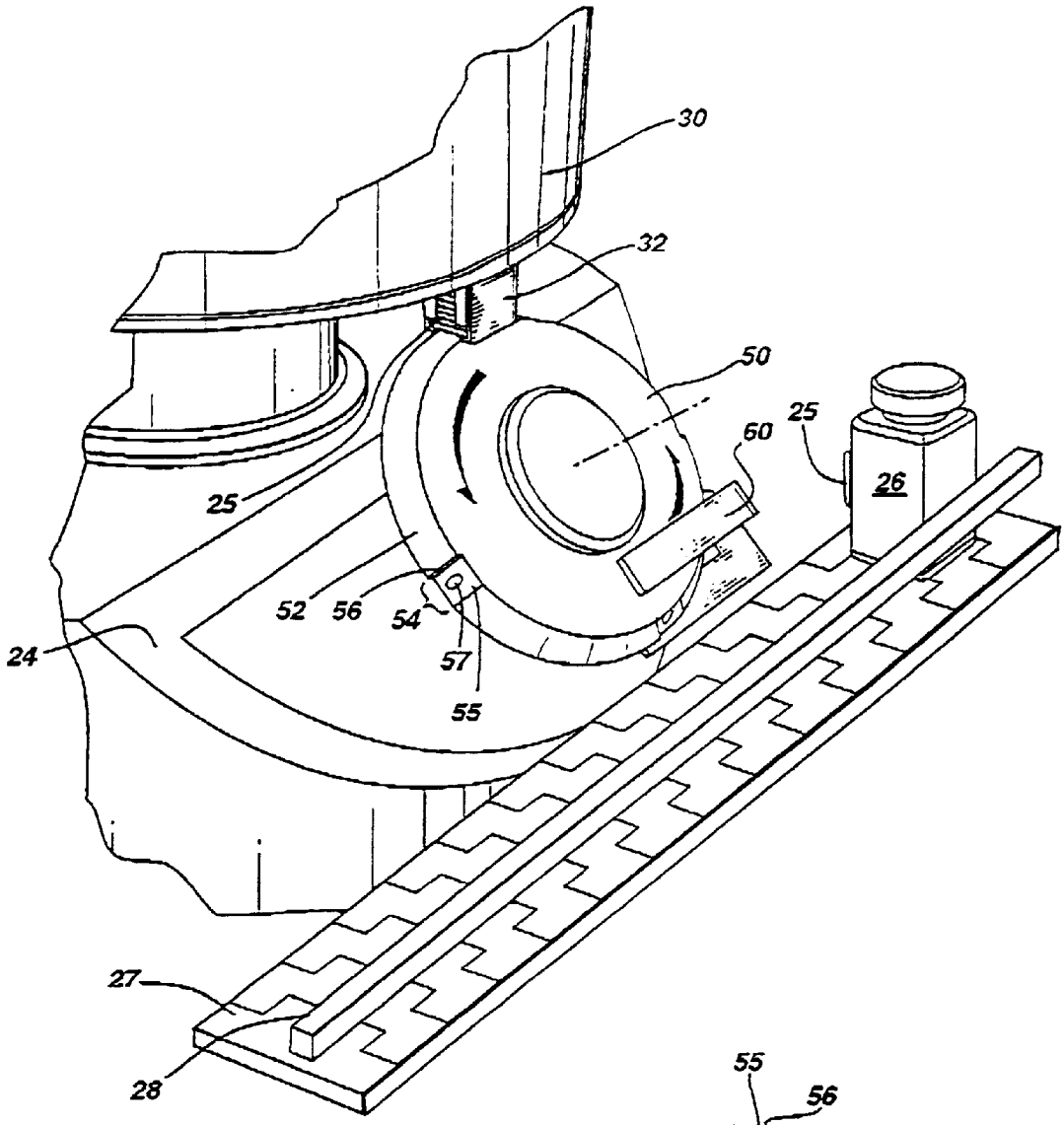
FIG. 3 is an enlarged perspective view of the mechanisms that dispense and positions the leaflets according to the invention.
Figure 4:
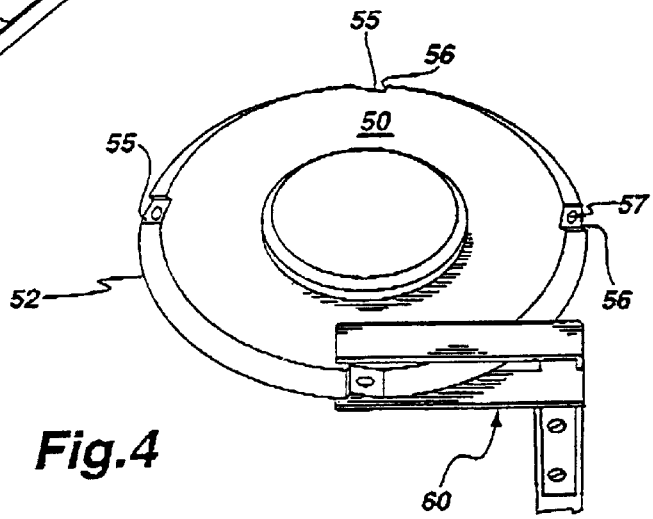
FIG. 4 is a perspective view of dispensing wheel according to the invention.

FIGS. 3 and 4 focus on the dispensing wheel 50 and its elements and ancillaries. The dispensing wheel 50 is a disc of sufficient thickness to provide support to a leaflet 25. The periphery 52 of the dispensing wheel 50 is angled and it features a plurality of pockets 54, each having a smoothly angled entry surface 55 and a sharply angled retaining edge 56. Inside each pockets 54, is a small vacuum chamber 57 located on the entry surface 55. The purpose of chamber 57 is to create a suction of sufficient force to remove a leaflet 25 from an intermediate chute 32 and hold the leaflet 25 as the dispensing wheel 50 rotates and transports the leaflet 25 towards the conveyor system 27.

A dispensing blade 60 is provided to cooperate with the dispensing wheel 50 to position leaflets 25 onto containers 26 or inserting leaflets 25 into containers 26. The dispensing blade 60 is preferably activated with a pneumatic actuator 62 (shown in FIG. 5 and FIG. 6). At the opportune time, the dispensing blade 60 moves towards a container 26 passing on the conveyor 27 and in the process, pushes a leaflet 25 held in a pocket 54 onto the top or the side of container 26 or into container 26. There are two types of dispensing blades 60 which are of similar design. The first type has an extended upper flange to push the leaflet onto the cap of container 26 or into the container 26 while the second type has an extended lower flange instead, to push the leaflet onto the side of container 26.

Figure 5:
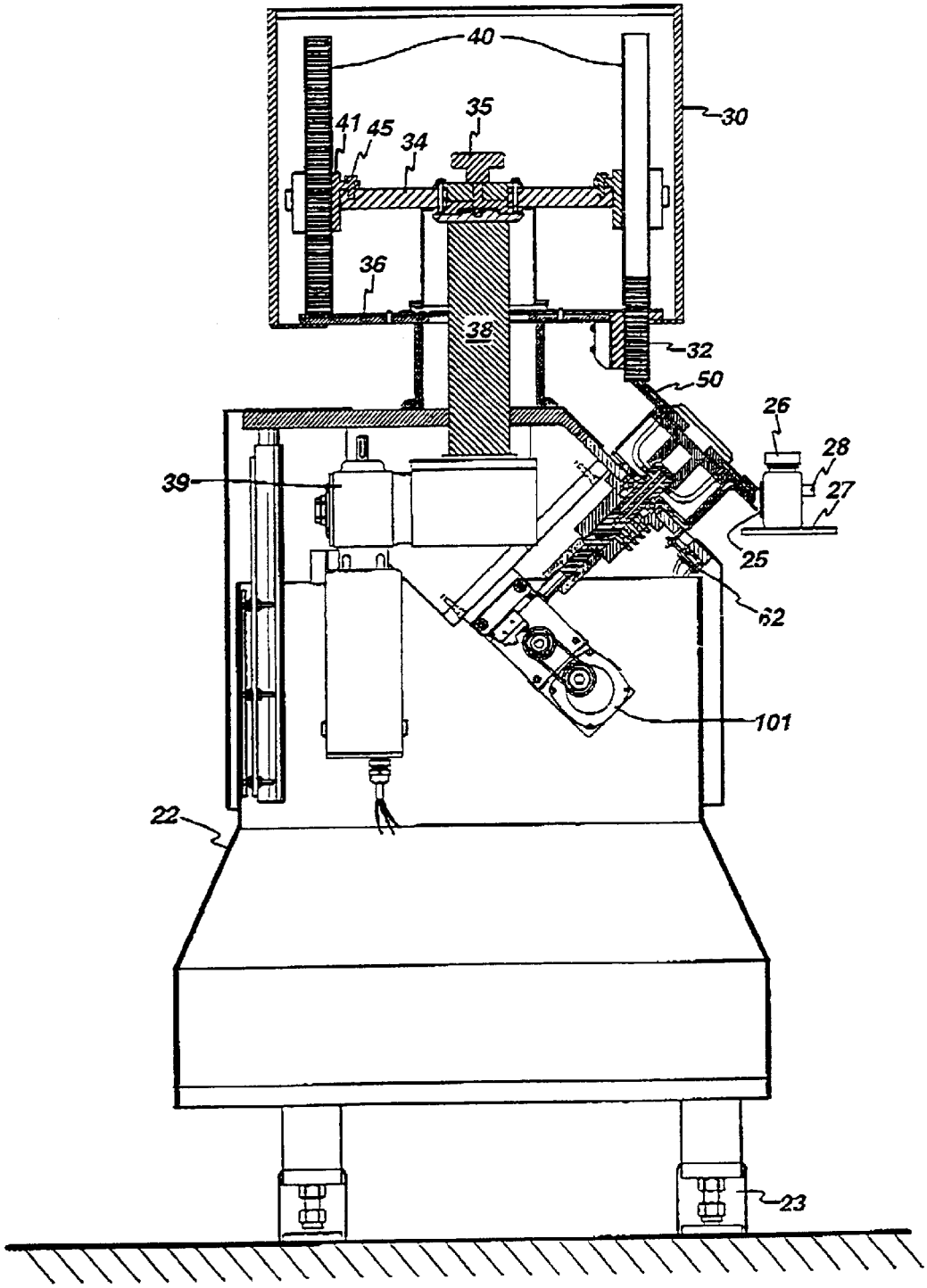
FIG. 5 is a side elevation view taken at line 5—5 of FIG. 1 illustrating the internal parts of the leaflet dispensing apparatus according to the invention.
Figure 6:
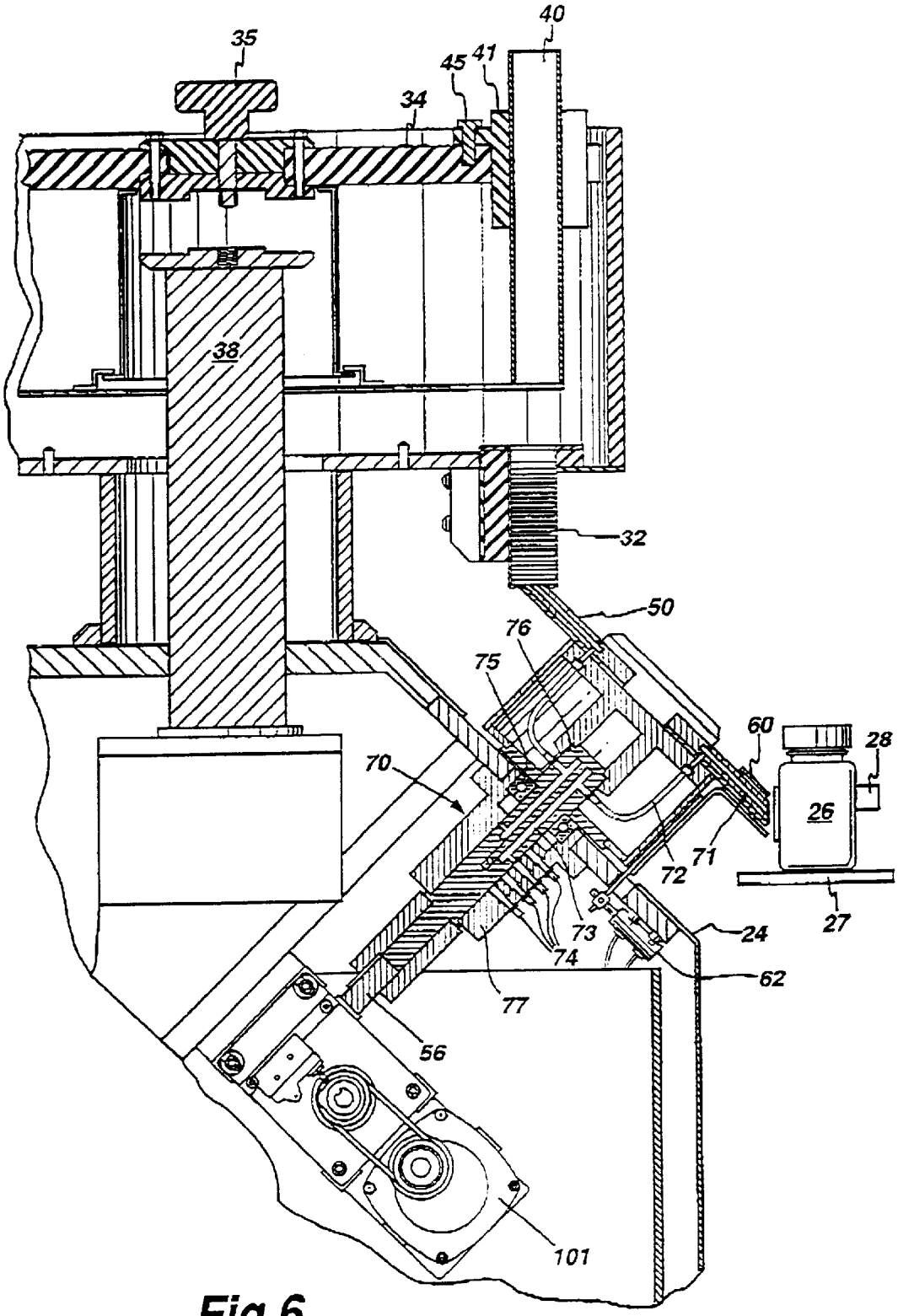
FIG. 6 is an enlarged side elevational view illustrating the leaflet dispensing apparatus of FIG. 5 with the carousel being removed when empty.

Now referring to FIGS. 5 and 6, it can be seen that the periphery 52 of the dispensing wheel 50 is angled in such a way as to enable the removal of a leaflet 25 from the substantially vertical intermediate chute 32 and the delivery of the same leaflet 25 onto a container 26. In a preferred embodiment, the periphery 52 of the dispensing wheel 50 is angled at 45 degrees in relation to the axis of rotation of the dispensing wheel 50. In this arrangement, the periphery 52 of the dispensing wheel 50 is substantially parallel to the leaflet 25 held in the intermediate chute 32 and it is also substantially parallel to the side portion of container 26 transported by the conveyor 27.

Referring to FIG. 6, the dispensing wheel 50 is mounted at its center to the central column 76 of the vacuum rotary connector 70. A motor 101 linked to the central column 76 through a shaft 56 imparts rotary motion to the central column 76. The central column 76 is supported at one end by its connection to the motor 101 and at its other end, by a central bearing 75. The vacuum rotary connector 70 is mounted to the angular section 24 of the main structural body 22. The axis of the vacuum rotary connector 70 is oriented at an angle consistent with the angle of the periphery 52 of the dispensing wheel 50. In a preferred embodiment, the vacuum rotary connector 70 is mounted to the angular section 24 at an angle of 45 degrees from the vertical.

The vacuum rotary connector 70 effectively imparts rotary motion to the dispensing wheel 50 and it also distributes vacuum pressure to the various chambers 57 of the dispensing wheel 50 by connecting a vacuum source to the various chambers 57 through vacuum lines. The vacuum chambers 57 previously described in FIGS. 3 and 4 are connected to vacuum lines 71 drilled into the dispensing wheel 50. The vacuum lines 71 communicate with the central column 76 through vacuum lines 72 located underneath the dispensing wheel 50. The central column 76 features vacuum lines 73 drilled through its center. Each vacuum line 73 is itself linked to a vacuum source (not shown) by the ports 74 of the body 77 of the vacuum rotary connector 70. Each of the vacuum lines 73 is connected with one port 74 via a groove at their mating point so that the vacuum connection is maintained for a predetermined segment of the total rotation of the rotating column 76. This vacuum connection arrangement enables the vacuum pressure to be turned on or turned off in the various vacuum chambers 57 of the pockets 54 as a function of the geometrical position of the individual pockets 54.

Leaflets 25 to be dispensed are stacked up in individual magazines 40 which are held in the upright position in the carousel 30 by a central star-wheel 34. The carousel 30 is rotatably mounted at the central star-wheel 34 on a central post 38 and secured to the central post 38 with only one large handle screw 35 for easy installation and removal. The central star-wheel 34 and the central post 38 have a positioning mechanism (not shown) to insure that when the central star-wheel 34 is installed on the central post 38, it is in the proper radial orientation. The central post 38 is connected to a motor and gearbox 39 (as shown in FIG. 5) which imparts rotary motion to the carousel 30 in a step-like or indexed manner.

Figure 7:
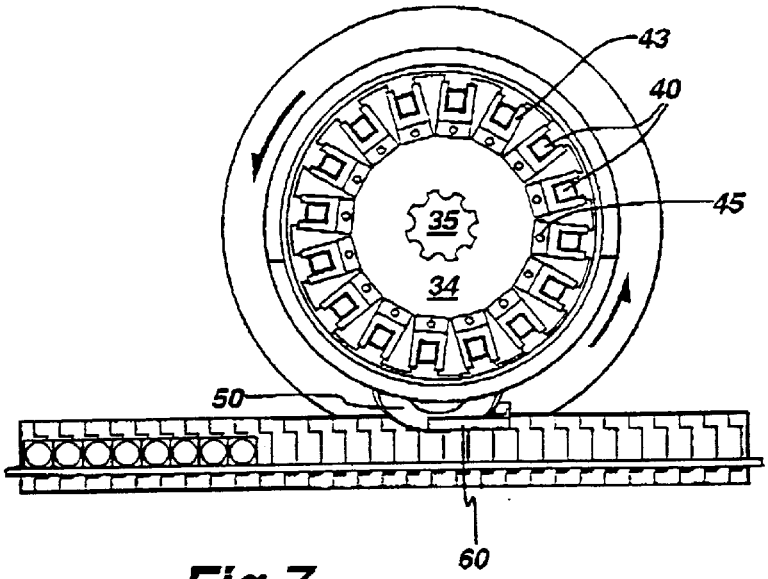
FIG. 7 is a top plan view of the leaflet dispensing apparatus according to the invention.

FIG. 7 illustrates a typical carousel viewed from above showing the radial positioning of each magazine 40. The rotary motion of the central post 38 is indexed into as many segments as there are magazines 40 in carousel 30. In the illustrated example, there are sixteen magazines 40; therefore the rotation of the central post 38 will be divided into sixteen equal segments of 22.5 degrees each. The number of magazines 40 stored in a carousel is not restricted to the illustrated example and can be any number. The rotary motion of the central post 38 simply has to be indexed in relation to the radial distance between two magazines 40 held in the carousel 30.

Figure 7A:
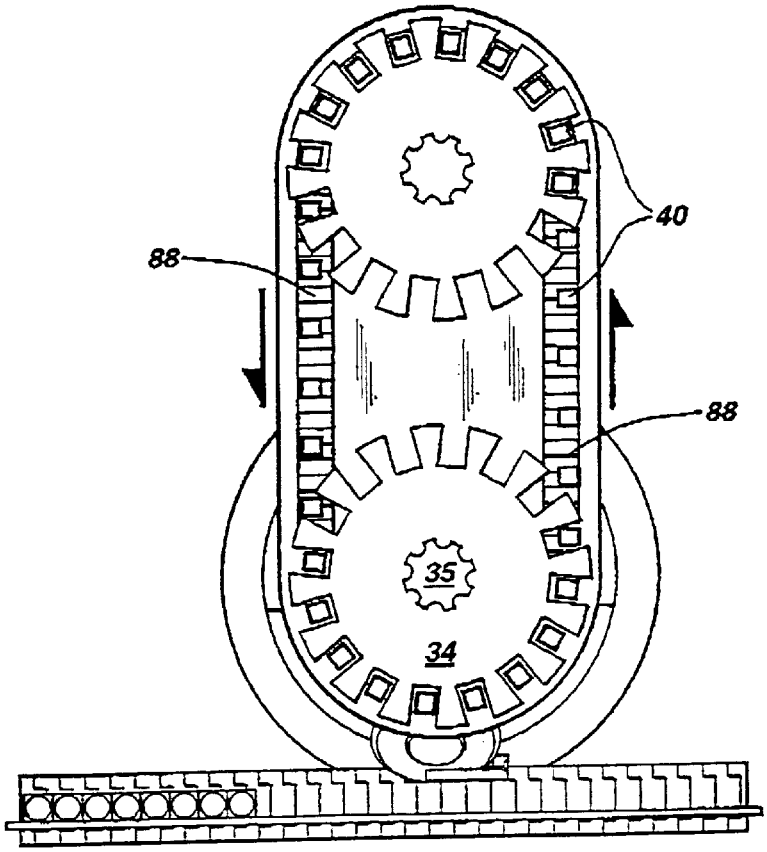
FIG. 7*a* is a top plan view of the leaflet dispensing apparatus illustrating a second embodiment of the carousel according to the invention.

As a variant of the carousel 30, FIG. 7*a* illustrates the magazines 40 mounted on a conveyor system 88. This arrangement permits the loading of more magazines 40 and therefore, more leaflets 25 into the apparatus. Empty magazines 40 may be replaced individually at a point downstream from the dispensing area or the entire conveyor system 88 may be replaced with a new one with full magazines 40. The conveyor system 88 operates essentially the same way as the carousel 30 wherein each magazine 40 is positioned in alignment with the intermediate chute 32 into which it unloads its leaflets 25. The displacement of the conveyor system 88 to replace an empty magazine 40 is also indexed in relation to the distance separating two magazines 40 held in the conveyor system 88.

Figure 8:
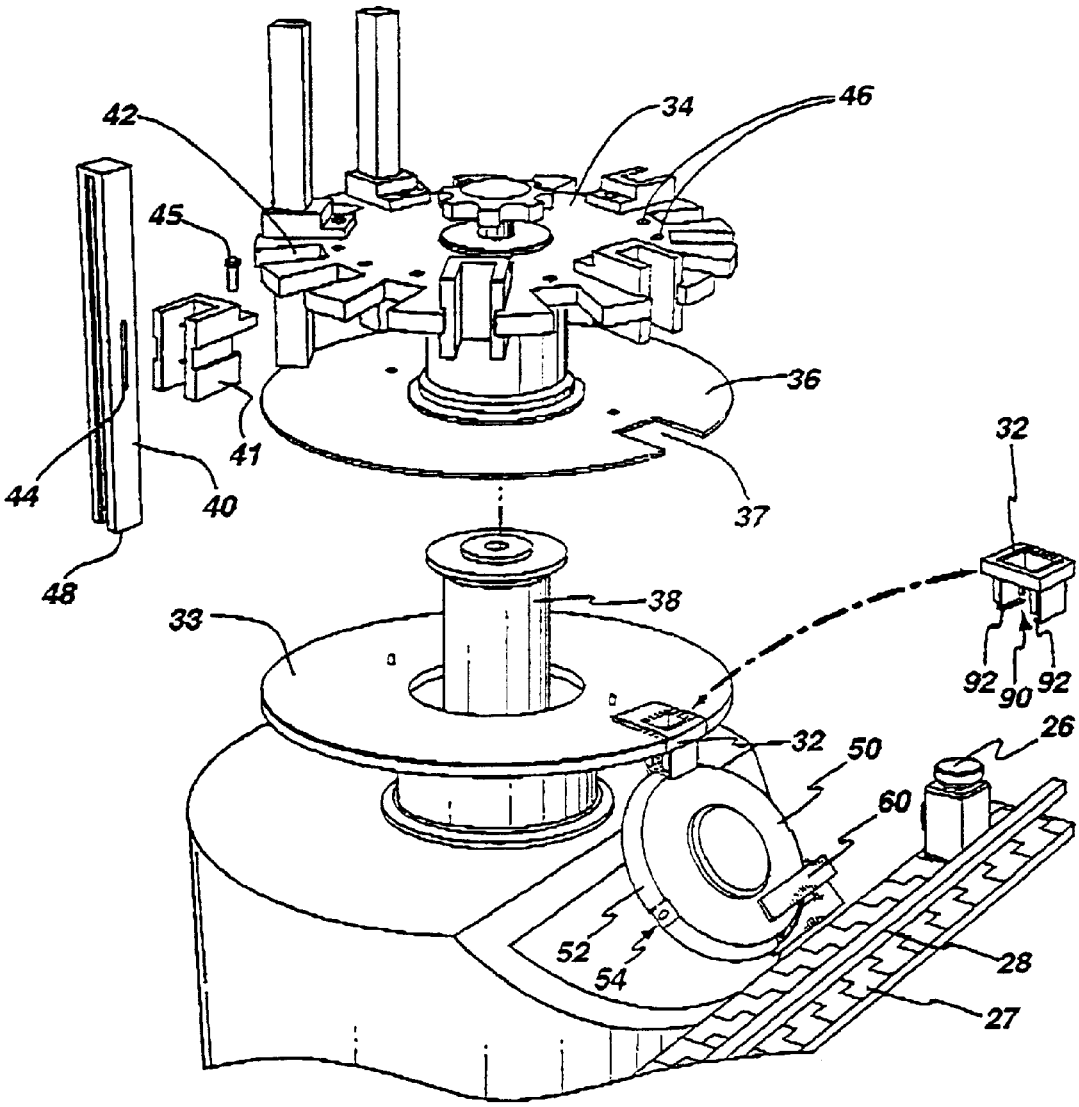
FIG. 8 is an exploded view of the leaflet dispensing apparatus according to the invention.

FIG. 8 is an exploded view of the main components of the carousel 30 showing at the bottom section of the carousel 30, a retaining plate 36 comprising an orifice 37 which opens onto the intermediate chute 32 located immediately below the retaining plate 36. The purpose of the retaining plate 36 is to partially support the magazines 40 and specifically to prevent leaflets 25 from escaping through the open end 48 of the magazines 40. The retaining plate 36 is oriented with its orifice 37 lined up with the intermediate chute 32 and does not rotate with the carousel 30. The upper surface of the retaining plate 36 is smooth to allow easy motion as the bottom leaflet 35 of every magazine 40 slides on this upper surface as the carousel 30 rotates.

Each magazine 40 is mounted to an aperture 42 of the star-wheel 34 with the agency of an adapter 41. The magazine 40 is positioned into the adapter 41 and held within by the mating of spring loaded dowels 43 with the grooved openings 44 located on each side of the magazines 40. The adapter 41 is mounted to the aperture 42 of the star-wheel 34 and locked into position by inserting a fastener 45 through the adapter 41 and into a hole 46 located behind each aperture 42.

The adapter 41 is provided so that the star-wheel 34 may accommodate a variety of magazines 40 of different sizes. The size of the magazine 40 essentially depends on the sizes of the leaflets 25.

The intermediate chute 32 is mounted to a support plate 33 on which the retaining plate 36 is seated. The intermediate chute 32 comes in a variety of sizes to accommodate leaflets 25 of different sizes; it can removed and replaced by an intermediate chute 32 of different size as need be. The purpose of the intermediate chute 32 is to create a buffer zone or a reserve of leaflets 25 so that when a magazine 40 is empty and the carousel rotates to bring a full magazine in line with the orifice 37 of the retaining plate 36, there are still leaflets available to the dispensing wheel 50. This arrangement prevents the flow of containers 26 from being stopped. The intermediate chute 32, as the magazines 40, is dimensioned to closely fit a particular size of leaflet 25 to insure that the leaflets are properly guided and do not become misaligned. The intermediate chute 32 features, at its bottom end 90, edges 92 adapted to hold the sides of a leaflet while leaving the central portion of the leaflet exposed to the dispensing wheel 50. As can be seen in FIG. 8, the periphery 52 of the dispensing wheel 50 is located directly between the edges 92 of the intermediate chute 32. The dispensing wheel 50 is therefore able to remove the exposed leaflet 25 when a pocket 54 passes by the intermediate chute 32 with the suction created by the vacuum chamber 57.

In operation, one magazine 40 of the carousel 30 is lined up with the orifice 37 leading to the intermediate chute 32. Leaflets 25 travel down by gravity into the intermediate chute 32. Once a magazine 40 has unloaded all its leaflets 25, the carousel 30 is rotated so as to bring into alignment with the orifice 37, the next full magazine 40. Once all the magazines 40 of the carousel 30 are empty, the empty carousel 30 is removed by simply undoing the large screw handle 35 (as shown in FIG. 6). A new carousel 30 with full magazines 40 is then installed and the screw handle 35 re-fastened.

Figure 9:
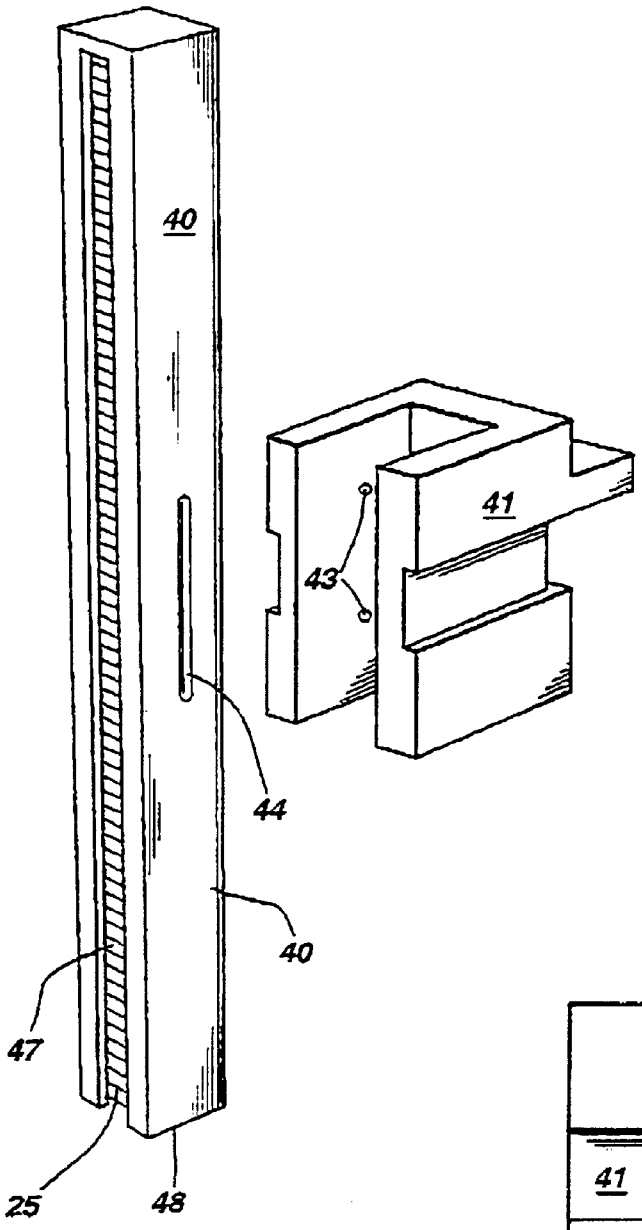
FIG. 9 is a perspective view of a typical leaflet refilling magazine according to the invention.
Figure 9A:
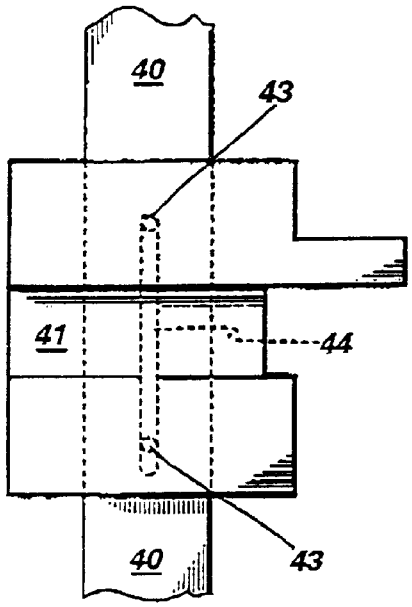
FIG. 9*a* is partial elevational view of the mechanism to secure a typical leaflet refilling magazine according to the invention.

Referring to FIGS. 9 and 9*a*, the magazines 40 are receptacles or cases adapted to hold leaflets to be dispensed. Magazines 40 Magazines 40 are tailor-made to fit different size of leaflets 25. The interior of the magazines 40 is dimensioned to closely fit a particular size of leaflet 25 so that the leaflets 25 are unable to rotate or become misaligned and therefore in the ideal orientation for dispensing. The magazines 40 are long, thin rectangular receptacles with one extremity 48 opened and have narrow grooved openings 44 on two opposite sides of the magazine 40 which are provided to secure the magazine 40 in a certain position into the adapter 41. The magazines 40 also features a long narrow aperture 47 extending substantially the length of the magazine 40 through which the amount of leaflets left in the magazine 40 can be verified. Leaflets 25 are inserted in the magazine 40 through the open extremity 48 and oriented so that when the magazine 40 stands upright, the leaflets 25 are stacked up. The magazine 40 is positioned into the adapter 41 and held within the adapter 41 by the mating of spring loaded dowels 43 with the grooved openings 44 located on each side of the magazines 40 as shown in FIG. 9*a*. It can be seen that a small gap exist between the lower spring loaded dowels 43 and the bottom of the narrow grooved openings 44 which permits some minor movements of the magazine 40. The magazines 40 are installed in the carousel 30 with the open extremity 48 facing down. In operation, the stacked leaflets 25 are discharged through the open extremity 48 into orifice 37 of the retaining plate 36 and into the intermediate chute 32. Magazines 40 can be produced out of inexpensive molded material which can be simply discarded after use. Magazines 40 can also be produced out of a more rigid molded material permitting the recycling of magazines 40 by returning them to the leaflets manufacturer for reloading. Magazines 40 can also be of a more permanent type for the purpose of on-site reloading. The magazine 40 is removed from carousel 30, refilled with new leaflets and reinstalled in the carousel 30.

Figure 11:
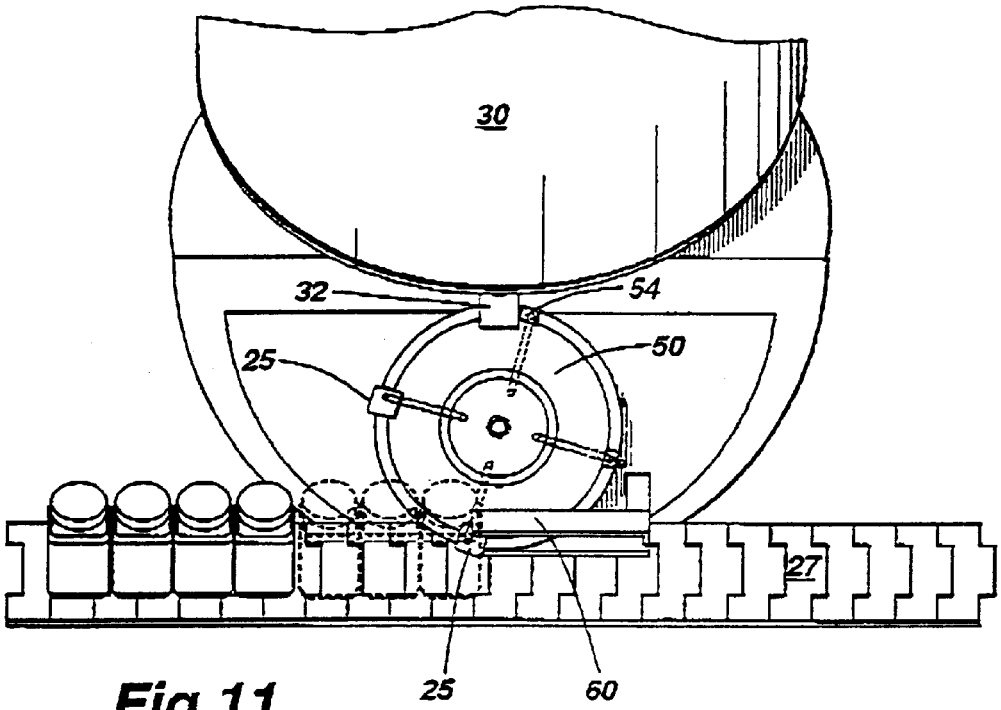
FIG. 11 is a plan view of the leaflet dispensing apparatus according to the invention taken at line 11—11 of FIG. 10.
Figure 10:
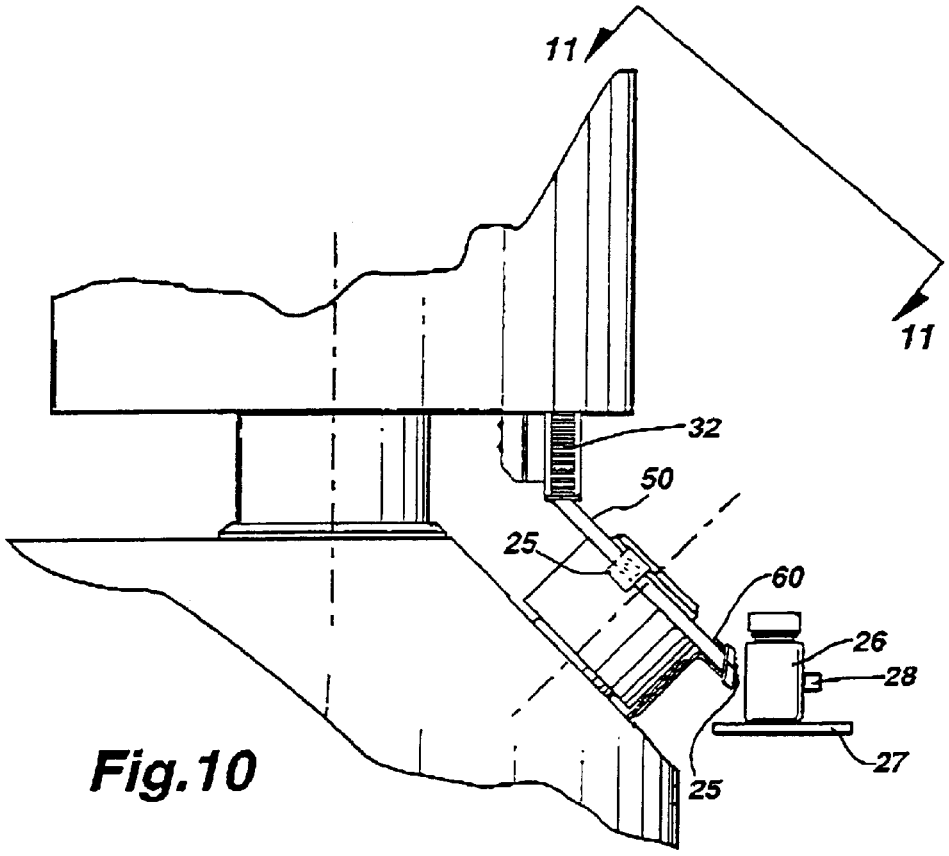
FIG. 10 is an enlarged side elevational view of the leaflet dispensing apparatus according to the invention prior to affixing a leaflet on a container.
Figure 13:
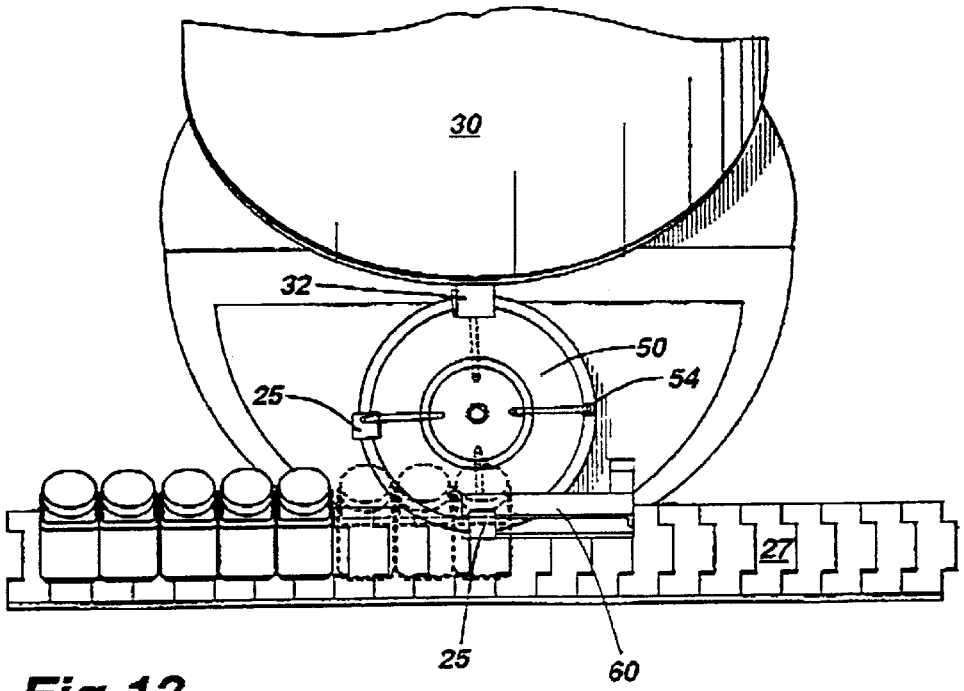
FIG. 13 is a plan view of the leaflet dispensing apparatus according to the invention taken at line 13—13 of FIG. 12.
Figure 12:
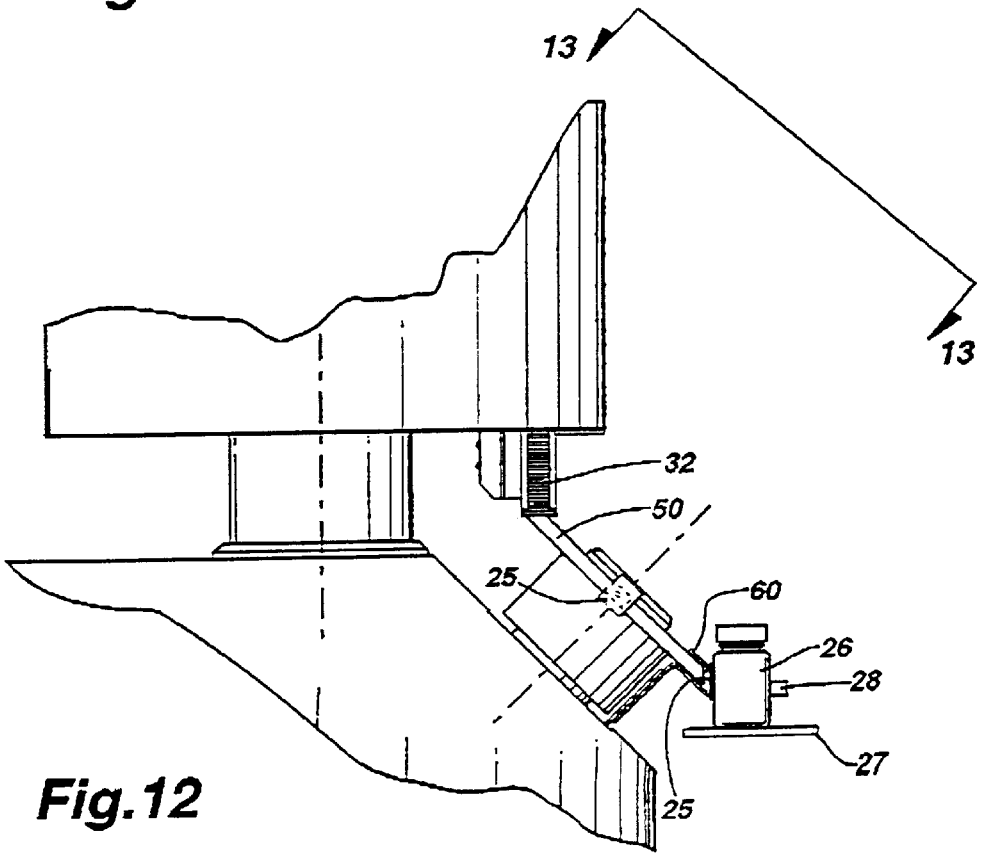
FIG. 12 is an enlarged side elevational view of the leaflet dispensing apparatus according to the invention affixing a leaflet on the side of a container.

FIGS. 10 to 13 illustrate the dispensing wheel 50 and dispensing blade 60 in operation from two points of view and at two different moments. In FIGS. 10 and 11, the dispensing wheel 50 is shown in a counterclockwise rotation, the dispensing blade 60 is retracted, a pocket 54 of the dispensing wheel 50 is about to pick up a leaflet 25 from the intermediate chute 32, a second pocket 54 is carrying a leaflet 25 toward the containers 26, a third pocket 54 is about to release a leaflet 25 onto a container 26 and a fourth pocket 54 is empty after having released a leaflet 25. FIGS. 12 and 13 illustrate the leaflet dispensing apparatus 20 one instant later. In FIG. 13, the pocket 54 located at the 12 o'clock position pulls a leaflet 25 from the intermediate chute 32 with the suction force created by the vacuum chambers 57 inside the pocket 54. At the 9 o'clock position, a glue dispensing device may be installed (not shown) to apply a thin layer of glue to the leaflet 25 held and carried by the dispensing wheel 50 as it passes by that position. At the 6 o'clock position, the vacuum rotary connector 70 shuts the vacuum pressure of the particular pocket 54 at the same moment the dispensing blade 60 extends and pushes the leaflet 25 onto the passing container 26. During the leaflet dispensing sequence, the container 26 is held in place, from the opposite end, by the guide rail 28 which prevents the container 26 from falling off the conveyor belt 27. The dispensing blade 60 applies a small pressure to the leaflet 25 to ensure that the glue applied previously on the leaflet 25 adheres firmly to the container 26.

FIG. 14 illustrates the variant in which the leaflet 25 is positioned and affixed to the top portion of the container 26. It can be seen that the dispensing blade 60 used for this purpose has a longer upper flange that the model used for positioning leaflets 25 to the side of the containers 26. Either type of dispensing blade 60 may be used when leaflets 25 are to be inserted into the container 26. When inserting leaflets 25, the containers 26 are transported on the conveyor belt 27 without their lids so that when a leaflet 25 is pushed by the dispensing blade 60, the leaflet 25 falls into the container 26.

The above description of preferred embodiments should not be interpreted in a limiting manner since other variations, modifications and refinements are possible within the spirit and scope of the present invention. The scope of the invention is defined in the appended claims and their equivalents.

We claim:

1. A leaflet dispensing apparatus comprising:

a main structural body;

a carousel rotatably mounted to said main structural body, said carousel including a plurality of magazines adapted to hold leaflets, each of said magazines having at least one open extremity through which said leaflets may enter or exit, said magazines being disposed in an upright position wherein said at least one open extremity opens downwardly;

a retaining plate positioned below said magazines and adapted to close said at least one open extremity, said retaining plate including an orifice in communicative relation with an intermediate chute;

a dispensing wheel rotatably mounted to said main structural body having an angled peripheral side, said peripheral side including at least one pocket adapted to remove and transport said leaflets, said dispensing wheel in communicative relation with said intermediate chute; and a dispensing blade adapted to move a leaflet carried by said dispensing wheel towards a container.

2. A leaflet dispensing apparatus as defined in claim 1, wherein said dispensing blade is activated by an pneumatic motor; said dispensing wheel is operated by another motor.

3. A leaflet dispensing apparatus as defined in claim 1, wherein said at least one pocket further comprises a vacuum chamber whereby said vacuum chamber is in communication with a vacuum source whereby creating a force capable of holding a leaflet in said at least one pocket.

4. A leaflet dispensing apparatus as defined in claim 3, wherein said at least one pocket further comprises an entry surface and a retaining edge.

5. A leaflet dispensing apparatus as defined in claim 1, wherein said carousel includes a star wheel, a support plate, a retaining plate, and is revolvable about a column; said column being rotatable by a motor and gear box.

6. A leaflet dispensing apparatus as defined in claim 5, wherein said carousel further comprises an adapter for securing said magazines to said star wheel.

7. A leaflet dispensing apparatus as defined in claim 6, wherein said adapter includes edges adapted to retain a leaflet.

8. A leaflet dispensing apparatus as defined in claim 5, wherein said carousel further comprises an conveyor adapted to retain said magazines.

9. A leaflet dispensing apparatus adapted to deposit pieces of folded printed matter into or onto small containers in a production line; said apparatus including a support, a main structural body and a revolvable carousel, said carousel being, in operation, adapted to transport a plurality of vertically disposed cartridges; said cartridges being adapted to be filled with said pieces of folded printed matter and to dispense the same by gravity into an intermediate chute; said apparatus further comprising a rotatable dispensing wheel having an angled peripheral side; said dispensing wheel including a plurality of vacuum-actuated pockets about its periphery; each of said pockets being adapted in operation to receive one of said pieces of folded printed matter from said chute; said dispensing wheel being positioned on said apparatus such that each of said pockets is adapted to align one at a time with an exit port of said intermediate chute during rotation of said dispensing wheel; the periphery of said wheel being positioned adjacent a container conveyor and a removal knife such that, in operation, as each of said pockets approaches said conveyor said knife removes said pieces of folded printed matter and deposits it into or onto a container.

10. An leaflet dispensing apparatus as defined in claim 9, wherein said knife is activated by an pneumatic motor; said rotatable dispensing wheel is operated by another motor; and said pockets are in communication with a vacuum source.

11. An apparatus as claimed in claim 9, wherein said carousel includes a star wheel, a support plate, a retaining plate, and is revolvable about a column; said column being rotatable by a motor and gear box.

* * * * *